United States Patent [19]

Ivanov et al.

[11] 4,267,789

[45] May 19, 1981

[54] METHOD OF ASSEMBLING MIDDLE BODY OF A VESSEL HULL

[76] Inventors: Jury P. Ivanov, Grazhdansky prospekt, 92/2, kv. 1; Evgeny A. Evstafiev, ulitsa Karpinskogo, 31, korpus 1, kv. 139; Alexandr E. Tarasov, Tallinskaya ulitsa, 6a, kv. 23, all of Leningrad, U.S.S.R.

[21] Appl. No.: 905,466

[22] Filed: May 12, 1978

[30] Foreign Application Priority Data

May 17, 1977 [SU] U.S.S.R. ..... 2528811

[51] Int. Cl.[3] ..... B63B 3/04

[52] U.S. Cl. ..... 114/65 R; 114/77 R

[58] Field of Search ..... 114/65 R, 77 R

[56] References Cited

U.S. PATENT DOCUMENTS 3,447,503 6/1969 Myers ..... 114/65 R
3,478,525 11/1969 Van der Hoeven ..... 114/65 R X
3,698,344 10/1972 Maeda ..... 114/77 R
3,703,153 11/1972 Maeda ..... 114/77 R
3,875,887 4/1975 Futtrup et al. ..... 114/65 R X
4,003,326 1/1977 Horii et al. ..... 114/65 R

*Primary Examiner*—Sherman D. Basinger

[57] ABSTRACT

A method of assembling middle bodies of vessel hulls for vessels to be used for the transportation of liquid, granular and gaseous cargoes, comprising preliminarily installing, between starboard side and port side D-type modules of the middle body, a deck section, a bottom section and a cross bulkhead outside the place of assembly of the middle body of a vessel hull thereby assembling a complete module. Then the assembled complete module is transferred to the place of assembly of the middle body of a vessel hull and attached to previously assembled and installed similar modules. The volume of the slipway operations is thus considerably reduced, hence the slipway time of the ship building period is cut down.

1 Claim, 4 Drawing Figures

METHOD OF ASSEMBLING MIDDLE BODY OF A VESSEL HULL

The invention relates to the shipbuilding industry, and more specifically to methods of assembling middle body of vessel hulls for vessels to be used for the transportation of liquid, granular and gaseous cargoes. Such vessels include tankers, bulk carriers, ore-carriers and combination ships of all types (OO,OB,OBO, PROBO-type vessels), as well as gas tankers of the LNG and LPG-types.

This method may be most widely used with the greatest advantages for the assembly of vessels in the range of from 20,000 to 500,000 dwt.tons.

A conventional modern method of assembling a hull of any vessel comprises assembling it from planar and three-dimensional sections delivered to the building site by cranes.

Limited lifting capacity of cranes does not make it possible to increase the weight of the sections to the values which are technologically advantageous so that the percentage of the assembly and outfitting operations at the building site increases thereby prolonging the slipway time of the vessel building period.

An attempt was made in Japan to dispense with the employment of cranes for the assembly of a middle body of a vessel hull and to transfer the major part of the assembly operations from the dock to the area adjacent to the dock. In accordance with this method, a middle body is assembled of starboard side and port side D-type modules, deck and bottom sections and cross bulkheads of the central part of the middle body.

The D-type module is a rigid structure formed by side, bottom and deck sections and by lengthwise and cross bulkhead sections. In some applications there is no cross bulkhead. Overall dimensions of D-type modules, e.g. for a tanker of 500,000 dwt. tons are $21\times23\times37$ m with a mass of up to 1400 tons. Such modules are transferred by using floor transporting means without using cranes. The modules are assembled outside the building area in the horizontal position (with the horizontal plane of the cross bulkhead of the module) in a specially designed assembly jig having a traveling crane. The assembled module is wheeled up to a welding tilter on transportation trolleys for welding in a position which better suits a welder. After the welding operations are completed, the module in the horizontal position is fed to a positioner to be turned thereby through 90° into the vertical position (the plane of the cross bulkhead is vertical) and lowered into the dock to install with the bottom thereof on transportation trolleys of the dock. Then the D-type module is transferred by means of the trolleys moving along a complicated system of longitudinal and transverse tracks to a point where it is attached to the previously assembled part of the middle body.

The bottom sections of the central part of the middle body are mounted before installation of the D-type modules, whereas the deck section and cross bulkheads are installed by means of dock cranes after installation of the D-type modules.

Nevertheless the above-described conventional method does not enable complete mechanization of the hull assembly operations since crane equipment is employed for the assembly of the central part of the middle body from sections and owing to a complicated system for the transportation of modules along the dock bottom, the labor consumption for the slipway operations increases thereby prolonging the slipway time of the shipbuilding period.

It is an object of the invention to reduce the volume of the dock operations, hence the time required for vessel assembly in the dock, and to raise the level of mechanization of the hull assembly operations.

Another object of the invention is to provide a method of assembling middle body of vessel hulls which reduces the time required for assembly operations for the assembly of the middle body to shorten the duration of the dock period and enables complete mechanization of the hull assembly operations.

These and other objects are accomplished by that a method of assembling middle body of vessel hull for vessels to be used for the transportation of liquid, granular and gaseous cargoes formed by a framing including starboard side and port side D-type modules, deck and bottom sections and cross bulkheads, according to the invention, comprises installing first the deck and bottom sections and the cross bulkhead between the starboard side and port side D-type modules thus assembling a complete module, with subsequent transfer of the assembled complete module to the area of assembly of the middle body of a vessel hull and attachment thereof to previously assembled and installed modules.

This enables the major part of operations of assembly and welding of complete modules to be transferred to the area beside the dock so that the level of mechanization of the hull assembly operations is raised and the dock period of the vessel assembly is shortened.

The complete module is preferably assembled while the plane of the cross bulkhead is in the horizontal position and is preferably turned into a position in which the plane of the bulkhead of the assembled module extends in parallel with those of the previously installed modules when the assembled module is attached to those previously installed.

This facility makes it possible to dispense with the assembly and welding operations in difficult positions (overhead assembly and welding) and to mechanize such operations.

During the assembly of the complete module, first the cross bulkhead is preferably installed between the starboard side and port side D-type modules, with subsequent installation of the deck and bottom sections.

Thus an arrangement for a crane-less assembly of the complete module may be provided to be incorporated in the production flow line for the assembly of the middle body.

The invention will now be described with reference to a specific embodiment thereof illustrated in the accompanying drawings, in which.

The method of assembling middle body of a vessel hull according to the invention resides in the following.

Figure 1:
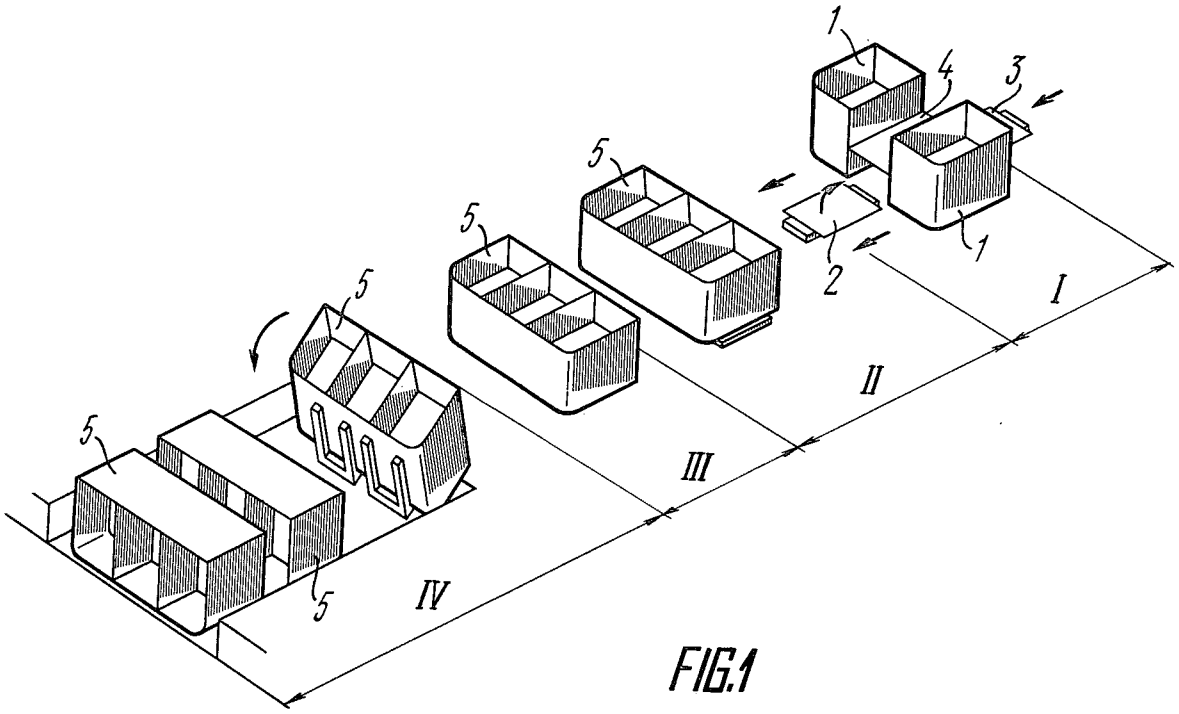
FIG. 1 shows the sequence of assembly of complete modules and middle body of a vessel hull, according to the invention.

First, starboard side and port side D-type modules 1 are assembled outside the place of assembly of the middle body of a vessel hull by methods similar to those described in U.S. Pat. Nos. 3698344, 3703153, 3875887 or by any other appropriate methods. The middle body of a vessel hull may be assembled in a dry dock, horizontal slipway platform, inclined slipway platform or the like. After the assembly of the D-type modules 1, they are transferred, in the horizontal position, to a station I for the assembly of a complete module (FIG. 1). The station I is located outside the place of assembly of the middle body of a vessel hull (station IV). A bottom section 2, a deck section 3 and a cross bulkhead of the central part of the middle body are also transferred in a sequence to the station I. The sections 2,3 and 4 are installed between the starboard side and port side D-type modules 1 thereby assembling a complete module 5.

Thus the complete module 5 comprises a component of the structure of the middle body of a vessel hull, which consists of the starboard side and port side D-type modules 1, and the bottom sections 2, decks section 3 and cross bulkhead section 4 of the central part of the middle body installed therebetween. The width of the complete module 5 is equal to the width of the middle body of vessel, the height thereof is equal to the height of the side of the middle body, whereas the length depends on the number of complete modules constituting the middle body. In some applications the cross bulkhead 4 may not be provided in the construction of the complete module.

After the complete module 5 is assembled at the station I, it is transferred to the station II for a final welding, and then to a painting station III. The number of intermediate stations to be inserted between the stations from I to IV depends on specific manufacturing process of assembly of the complete modules 5. Finaly welded and painted modules are transferred to the place of assembly of the middle body of a vessel hull (station IV) and attached to the modules previously assembled and installed at the place of assembly of the middle body of a vessel hull.

Preassembly of the complete module 5 outside the place of assembly of the middle body of a vessel hull enables the major operations of assembly, welding and painting of sections of the middle body (complete modules) to be transferred into a workshop outside the place of assembly of the middle body of a vessel hull, raises the level of mechanization of the hull assembly operations and considerably cuts down the slipway time of the shipbuilding period.

The complete module 5 is assembled in the horizontal position, that is the plane of the cross bulkhead is held horizontally. After the assembly the complete module 5 is transferred, in the horizontal position, to the station IV for assembly of the middle body of a vessel hull. The complete modules 5 are transferred to the assembly station by means of transportation trolleys or other vehicles (truck tractors, hovercraft carriers and the like). When the complete module 5 is transferred to the place of assembly of the middle body of a vessel hull (station IV) for attachment to previously installed modules, it is turned into a position in which the planes of the bulkheads of the new module and of those previously installed extend in parallel with one another. The module is turned, e.g. by using the arrangements similar to those described in the above-cited U.S. patents or any other appropriate arrangement.

The complete module 5 is to be turned to bring it into a position in which it should be installed at the place of assembly of the middle body of a vessel hull.

The assembly of the complete module in the horizontal position enables maximum possible mechanization and automation of the assembly and welding operations and eliminates overhead welding and assembly.

The assembly of the complete module is preferably effected in the following order.

Figure 2:
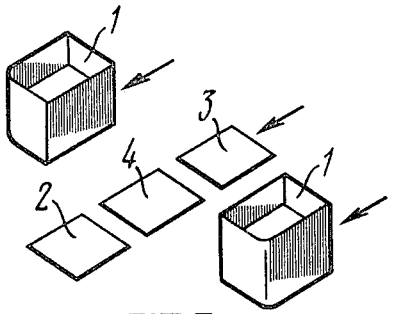
FIG. 2 shows the initial position of elements of the complete module before the assembly, according to the invention.
Figure 3:
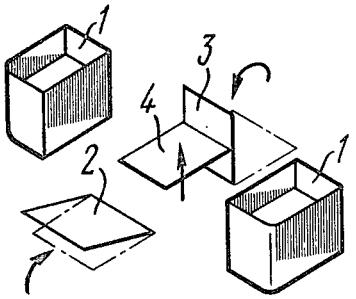
FIG. 3 shows the sequence of installation operations for the assembly of the central part of the complete module, according to the invention.
Figure 4:
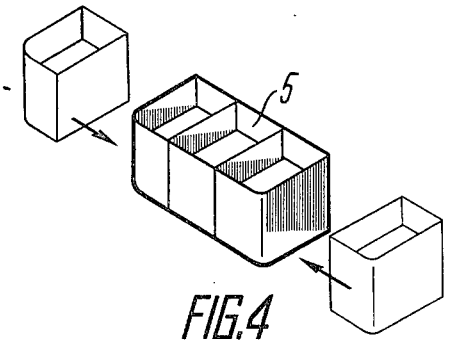
FIG. 4 shows the final operation in the assembly of the complete module, according to the invention.

After the D-type modules 1 and sections 2,3,4 are transferred to the assembly station (station I) and after the sections 2,3,4 are installed between the D-type modules 1 (FIG. 2), the cross bulkhead 4 is lifted, in the horizontal position, to a required height, while the deck section 2 and the bottom section 3 are tilted into the upright position (FIG. 3), the D-type modules 1 being in a position in which they do not interfere with the above-described operations. After the assembly of the central part of the complete module the D-type modules thereof are transferred into a position they must take in the complete module (FIG. 4), whereafter the tacking (prewelding) of D-type modules 1 and sections 2,3,4 is effected. In case there is no cross bulkhead in the complete module, the operation of lifting the cross bulkhead is naturaly dispensed with. After the tacking at the station I the complete module is transferred to a station for a final welding (station II) and then to the painting station (station III).

The method of assembling middle bodies of vessel hulls of complete modules according to the invention enables complete mechanization of assembly operations, eliminates the employment of dock cranes and considerably simplifies the system of transfer of hull structures within the place of assembly thus providing a flow line for the assembly of middle body exhibiting high productivity and substantially cutting down the slipway time of the assembly of the middle body due to a considerably reduction of labor consumption for slipway and outfitting operations. The method of assembling middle bodies of vessle hulls for vessels to be used for the transportation of liquid, granular and gaseous cargoes, using complete modules ensures a substantial improvement of the technological level of the hull assembly operations and raises this level to that of the up-to-date prefabrication operations; labor consumption for hull assembly and outfitting and assembly operations is reduced by 50–60% and the slipway time of the hull assembly operations is cut down by 40/50%.

What is claimed is:

1. A method of assembling middle bodies of vessel hulls for vessels to be used for the transportation of liquid, granular and gaseous cargoes which are formed by a framing extending the width of the vessel hulls and including bottom sections, deck sections, D-type modules and cross bulkheads, comprising:

assembling starboard side and port side D-type modules outside a place of assembly of a middle body of a vessel hull from a set of sections including deck sections, bottom sections, side sections and lengthwise and cross sections;

installing other deck and bottom sections of said set of sections and a cross bulkhead section between a pair of said starboard side and port side D-type modules, outside the place of assembly of the middle body of a vessel hull thereby assembling a complete module that forms framing extending the width of the vessel hull, said assembly including positioning said cross bulkhead and said other deck and bottom sections between starboard side and port side D-type modules, said modules being spaced apart from each other by a distance greater than the width of said cross bulkhead, lifting said cross bulkhead to an elevated horizontal position, tilting said deck and bottom sections to vertical positions and securing same to said elevated cross bulkhead to thereby form a central part of said module, and moving said starboard side and port side D-type modules towards said central part to thereby assemble said complete module;

transferring said complete module to the place of assembly of the middle body of the vessel hull and attaching it to previously assembled and installed modules, said complete module being assembled with the plane of said cross bulkheads in a horizontal position, and said transferring of said assembled complete module including turning said module into a position in which the planes of said cross bulkheads of the assembled complete module and those of previously installed modules extend in parallel with one another.

* * * * *